US005499438A

United States Patent [19]

Schutz

[11] Patent Number: 5,499,438

[45] Date of Patent: Mar. 19, 1996

[54] PROCESS FOR THE PRODUCTION OF A PALLET CONTAINER

[76] Inventor: Udo Schutz, Ruckersteg 4, D-56242 Selters, Germany

[21] Appl. No.: 272,387

[22] Filed: Jul. 6, 1994

[30] Foreign Application Priority Data

Jul. 6, 1993 [DE] Germany ..... 43 22 375.3

[51] Int. Cl.[6] ..... B23Q 17/00

[52] U.S. Cl. ..... 29/407.01; 29/421.1; 29/509; 29/521; 413/4; 413/6; 72/379.4

[58] Field of Search ..... 29/407, 421.1, 29/509, 521; 72/61, 379.4; 206/386; 413/2, 4, 6; 228/155

[56] References Cited

U.S. PATENT DOCUMENTS

| | | | |
|---|---|---|---|
| 1,227,830 | 5/1917 | Richards | 413/4 |
| 4,157,609 | 6/1979 | Schutz | 29/428 |
| 5,070,717 | 12/1991 | Boyd et al. | 29/421.1 |
| 5,357,667 | 10/1994 | Schutz | 29/509 |

FOREIGN PATENT DOCUMENTS

| | | | |
|---|---|---|---|
| 5499 | 1/1897 | United Kingdom | 413/2 |

*Primary Examiner*—David P. Bryant

*Attorney, Agent, or Firm*—Young & Thompson

[57] ABSTRACT

A pallet container (1) for liquids has a replaceable inner container (2) made of sheet metal, an outer jacket (6) made of latticework, as well as a pallet (9)in the form of a bottom tray (10), which receives the bottom (16) of the inner container. The inner container (2)is made of sheet steel, preferably constructed as a double-walled structure, and is welded together from a jacket (11), a bottom part (12) and a cover (13). For the production of the inner container, a rectangular sheet-metal blank is bent to form a pipe element, whose mating edges are welded lengthwise. The pipe element is stretched to form a jacket of rectangular cross section. Then, a peripheral bead with a V-shaped cross section in each of the two end areas of the jacket is formed at a distance from its edges, which then are cut. Then, the deep-drawn, tray-shaped bottom part with a rounded edge is superposed or joined exactly to the outer sides of one bead of the jacket and the bottom part is attached to the jacket. In the same way, the cover is attached to the jacket. The bottom part and cover are welded to the jacket. To make a smooth transition between the jacket and the bottom part, on the one hand, and jacket and cover, on the other hand, the transition areas between jacket and bottom part and jacket and cover are flared by pressurizing the inner container, which is placed in a supporting mold.

1 Claim, 9 Drawing Sheets

PROCESS FOR THE PRODUCTION OF A PALLET CONTAINER

FIELD OF THE INVENTION

The invention relates to a process for the production of a pallet container for liquids, with an inner container with a sealable feed opening and a drain and flushing opening and an outer lattice jacket made of metal resting on the inner container, as well as a bottom tray made of sheet metal designed as a pallet for positive accommodation of the inner receptacle and for fastening the lattice jacket, in which case the bottom of the bottom tray, which is matched to the bottom of the inner receptacle, has reinforcing beads whose bases lie in a common horizontal plane and which form downwardly opening chambers in the bottom of the tray, the flat bottom tray has an outer supporting edge bent downward, which forms a hollow supporting collar, and the bottom tray is fastened to a pallet frame made of metal, wood or plastic (DE 42 06 945 C1).

BACKGROUND OF THE INVENTION

The need to use raw materials sparingly and the legal environmental protection regulations require that the relevant industry decant liquids for transport and for storage in large-volume pallet containers of generic type designed as commercially available reusable containers instead of, as in the past, in drums with significantly smaller capacity.

The essential drawbacks of the generic pallet container, which are due to the fact that the inner container is made of plastic, are the following:

The formation, by fluorination, of barrier layers on the outside and inside of the plastic inner container cannot prevent the permeation of liquids such as solvents and solvent-containing liquids into the plastic, so that the possibilities for cleaning the pallet container are limited. According to the legal regulations, flammable liquids must not be stored in pallet containers with a plastic inner container, and no flammable liquids with a flash point of below 0° C. may be transported in such containers. Finally, the inner container has limited resistance to external impact or shock.

SUMMARY OF THE INVENTION

The object of the invention is to improve the generic pallet container with respect to its use for the transport and storage of liquids of all types and to provide a process for economical and reasonably priced production of the inner container of the pallet container.

The pallet container produced by a method according to the invention can be used for the transport and storage of liquids that are required for widely varying purposes in industry. In particular, the container can be used for the transport and storage of flammable liquids. Because it can be drained without dregs and can be cleaned in an optimum manner, avoiding liquid residues, due to the smooth design of the inner sides of jacket, bottom, and cover and the transitions between the jacket and bottom part as well as between the jacket and cover, the container is suitable for use in the food industry. The double-walled design of the inner container with inner sheets made of high-grade steel as corrosion protection and outer sheets made of standard steel, which support the side walls and the bottom of the container, makes it possible to reduce the wall thickness, specified for corrosion-resistant, single-walled sheet metal containers, from 2.5 to 3 millimeters by up to 50%, to 1.2 to 1.5 millimeters. The inner container made of sheet metal exhibits great stability in connection with the metal lattice jacket, which ensures maximum protection of the pallet container against external impact and shock and the ability to stack several such containers. The economical production process for the inner container made of sheet metal makes it possible to fabricate reasonably priced pallet containers with high quality.

BRIEF DESCRIPTION OF THE DRAWINGS

The invention is explained below based on the drawings wherein.

DETAILED DESCRIPTION OF THE INVENTION

Figure 1:
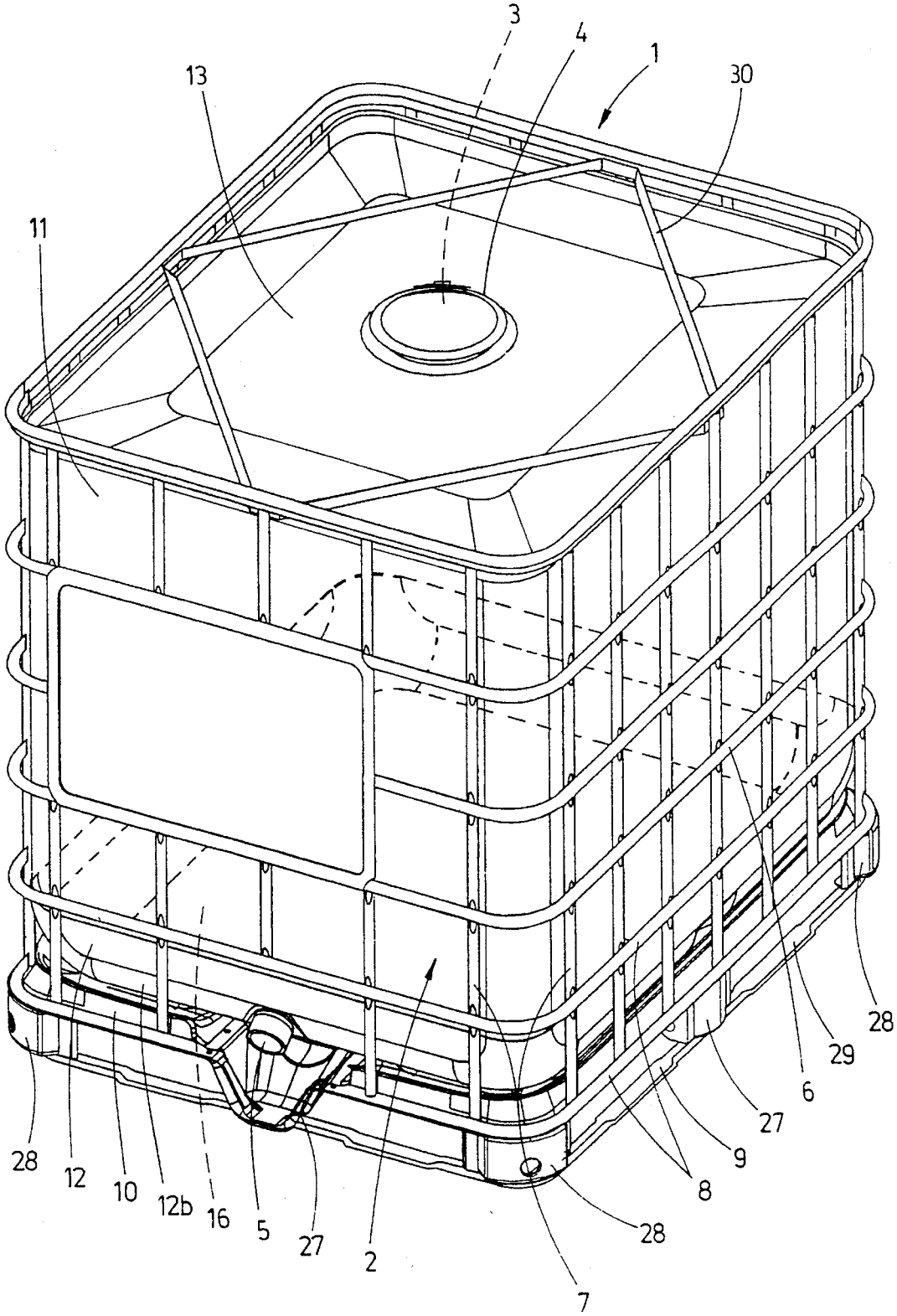
FIG. 1 is a perspective view of a pallet container with an inner container made of sheet metal, a lattice jacket and a pallet designed as a bottom tray.
Figure 2:
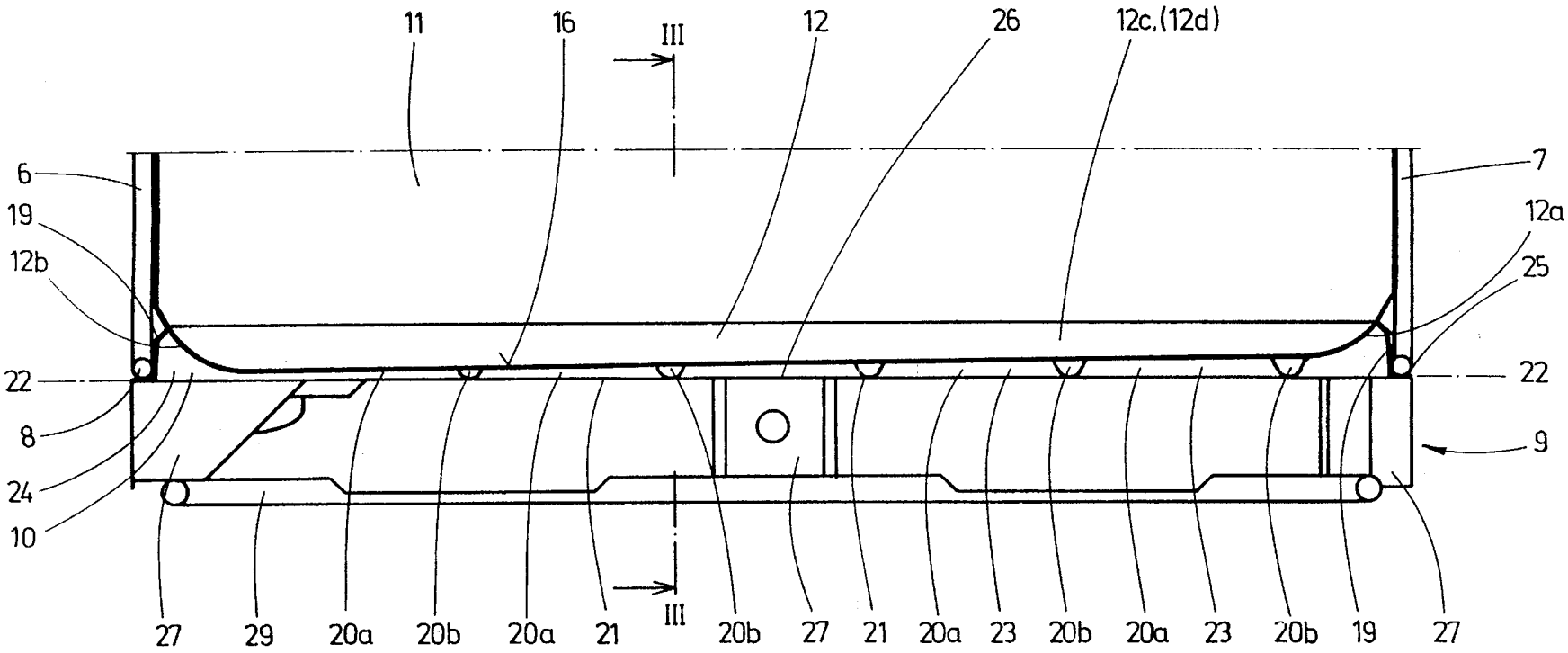
FIG. 2 is an enlarged longitudinal section.
Figure 3:
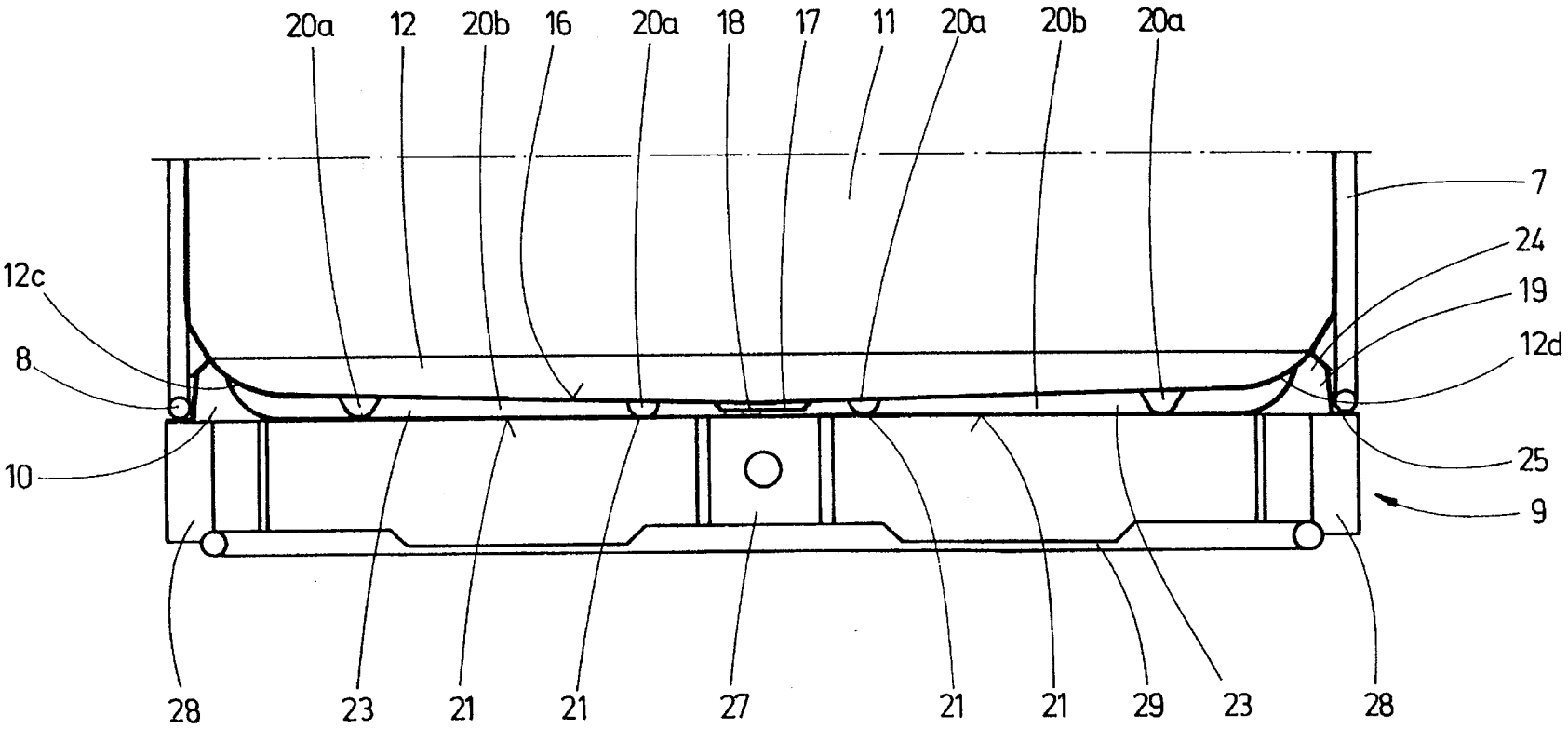
FIG. 3 is an enlarged cross-section through the bottom area of the pallet container along line III—III of FIG. 2.

Pallet container 1, which is used as a disposable and reusable container according to FIGS. 1 to 3 for the transport and storage of liquid material of different types, has as its main components a replaceable inner container 2 made of sheet metal with a rectangular outline and rounded corners, which is equipped with a filler neck 3 that can be sealed by a cover 4 with a tension ring and with another neck 5 in the bottom area to connect a drain and flushing valve, an outer jacket 6 made of crossing vertical and horizontal lattice bars 7, 8 made of metal as well as a pallet 9 designed as a flat bottom tray 10 made of sheet metal with length and width dimensions meeting European Standards for positive accommodation of inner container 2.

Figure 9:
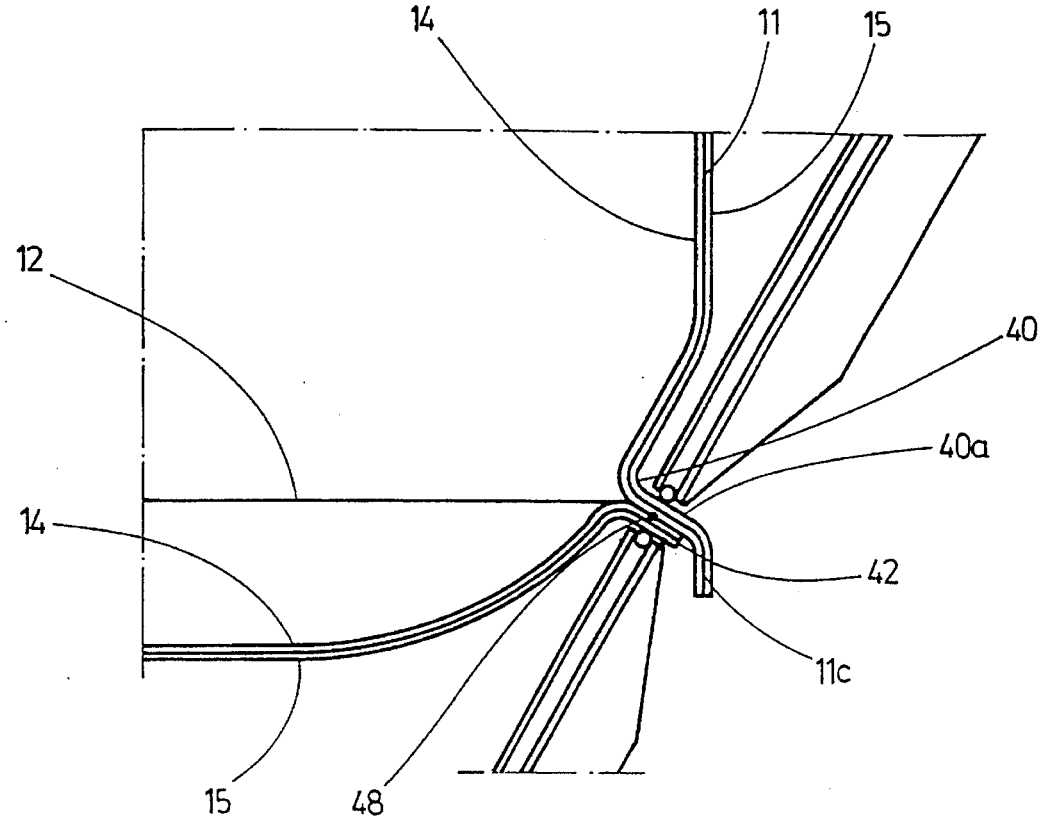
FIGS. 9 and 10 show the connection of the sheet metal jacket to the bottom part and the cover made of sheet metal by a seam weld.
Figure 11:
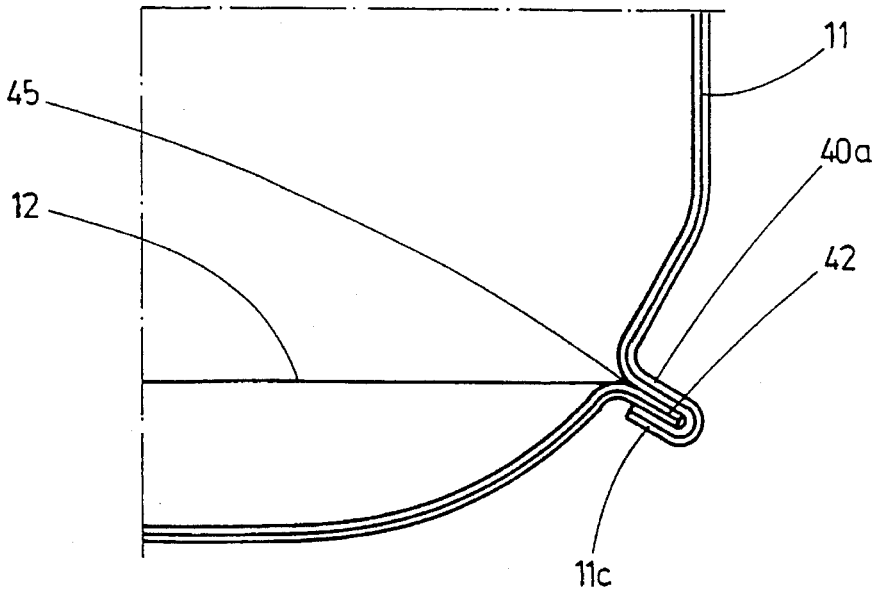
FIG. 11 shows the positive connection of the jacket to the bottom part.

Inner container 2 made of sheet metal is welded together from a jacket 11, a bottom part 12 and a cover 13. Jacket 11, bottom part 12 and cover 13 of inner container 2, designed as double-walled components, consist of a thin inner sheet 14 made of corrosion-resistant high-grade steel and an outer sheet 15 made of standard steel, which is thicker than inner sheet 14 (FIG. 9).

As an alternative to the described embodiment, inner container 2 can also be designed as a single-walled container.

Bottom part 12 of inner container 2 has a drain bottom 16, which runs with a slight slope from back edge 12*a* to front edge 12*b* of bottom part 12 and which also slopes slightly from two lateral edges 12*c*, 12*d* of bottom part 12 toward the center of the bottom. In this way, bottom 16 of bottom part 12 of inner container 2 forms a flat drain trough 17 which slopes slightly toward connecting piece 5 in front edge 12*b* to connect a drain and flushing valve, preferably a ball or flap valve.

Bottom tray 10 of pallet 9, which is made of deep-drawn sheet metal and is adapted in its slope to drain bottom 16 of inner container 2, with a flat center trough 18 corresponding to drain trough 17 of inner container 2, has an outer supporting edge 19, which is bent downward, and reinforcing beads 20*a*, 20*b* running in the direction of and crosswise to center trough 18, whose bases 21 lie in a common plane 22—22. Chambers 23, which are open downward, are formed in bottom tray 10 by reinforcing beads 20*a*, 20*b* and center trough 18, and outer supporting edge 19 forms a peripheral hollow supporting collar 24 on bottom tray 10. Bottom tray 10 of pallet 9, thus configured, is distinguished by good damping capacity and high stiffness both in the case of vibration stress caused by driving vibrations produced by a transport vehicle and surge vibrations arising from the liquid being transported and in the case of external impact or shock, so that pallet container 1 meets stringent requirements overall with respect to the necessary transport and accident safety.

A peripheral outer edge strip 25, which forms an underframe with a reinforcing strut 26 fastened in the center under bottom tray 10, is angled away from outer supporting edge 19 of bottom tray 10.

Lattice jacket 6, which is attached by peripheral supporting collar 24 of bottom tray 10 to pallet 9, rests on lower horizontally arranged peripheral lattice bar 8 or a lower end profile on edge strips 25 of bottom tray 10, and lattice jacket 6 is screwed down by lower horizontal lattice bar 8 together with bottom tray 10 as well as center feet 27 and corner feet 28 on pallet frame 29, which is designed as steel-tube frame.

Lattice jacket 6 is reinforced by an upper frame 30 that is screwed to the lattice jacket, which protects inner container 2 from above.

The modular design of the pallet container makes it simple and quick to assemble the container and easy to replace the inner container made of sheet metal with an inner container made of plastic.

Figure 4:
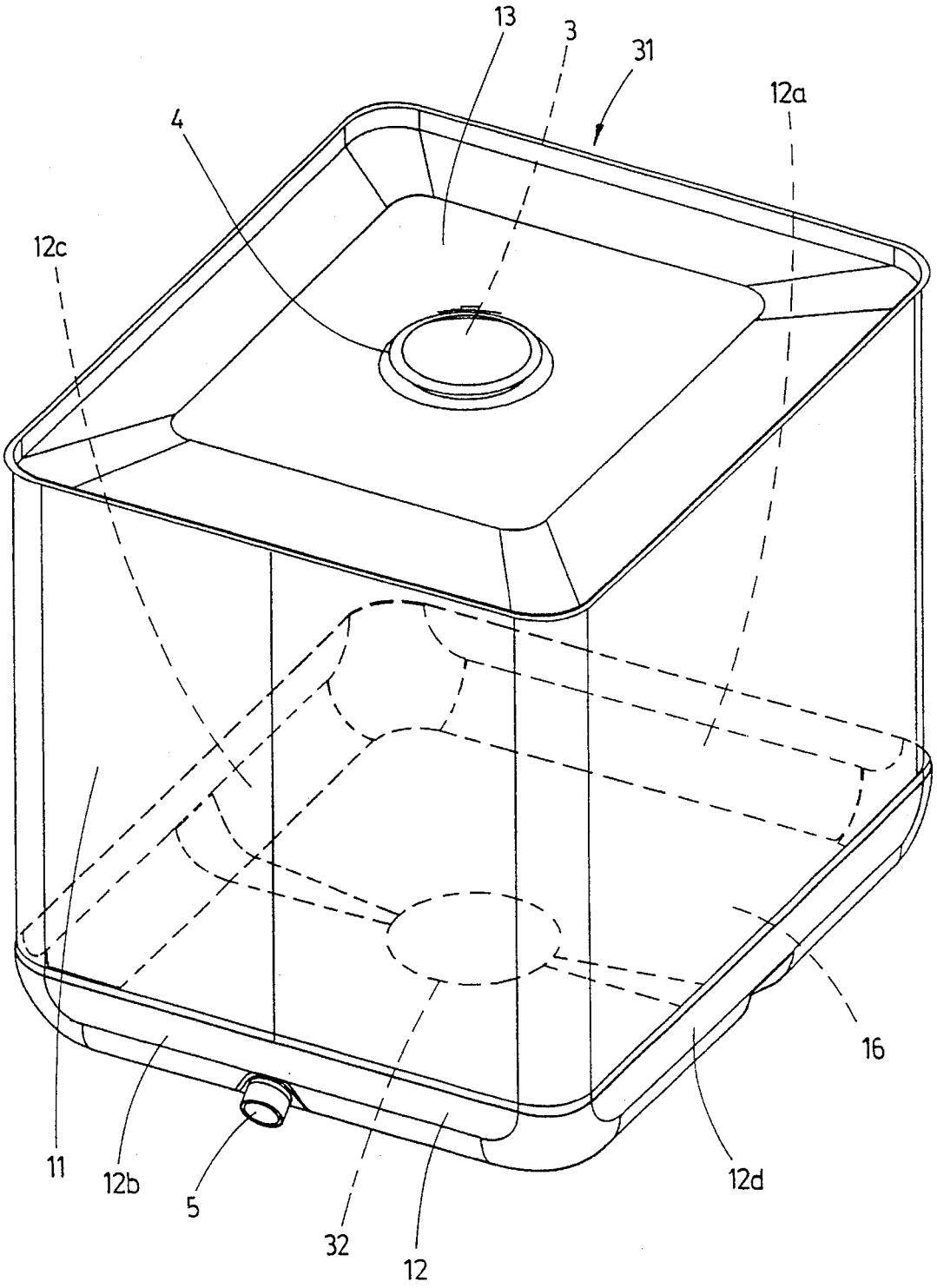
FIGS. 4 shows a perspective view of a modified embodiment of the inner container.

In the case of an inner container 31 according to FIG. 4, drain bottom 16 slopes slightly from all edges 12*a*–12*d* of bottom part 12 toward the center, and bottom 16 has a central drain and flushing opening 32 with a connection for a drain and flushing device, for which in the case of drain opening 32 there is a corresponding opening in the bottom of the bottom tray, whose shape is adapted to the drain bottom of the inner container.

Figure 5:
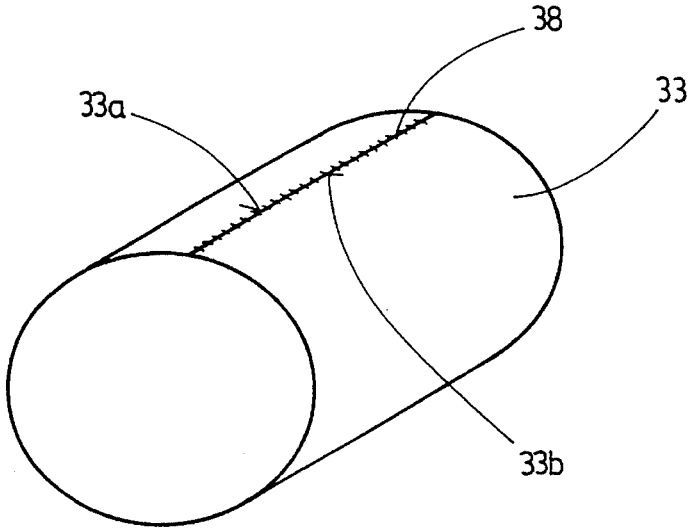
FIGS. 5 to 7 show three process stages in the production of the jacket of the inner container made of sheet metal.

For the production of double-walled sheet metal jacket 11 of inner container 2, a rectangular sheet metal cutaway portion, not shown, made of a high-grade steel sheet and a standard steel sheet is bent to form a pipe element 33, and then its mating edges 33*a*, 33*b* are shifted lengthwise on, e.g., a body-welding machine (FIG. 5).

Figure 6:
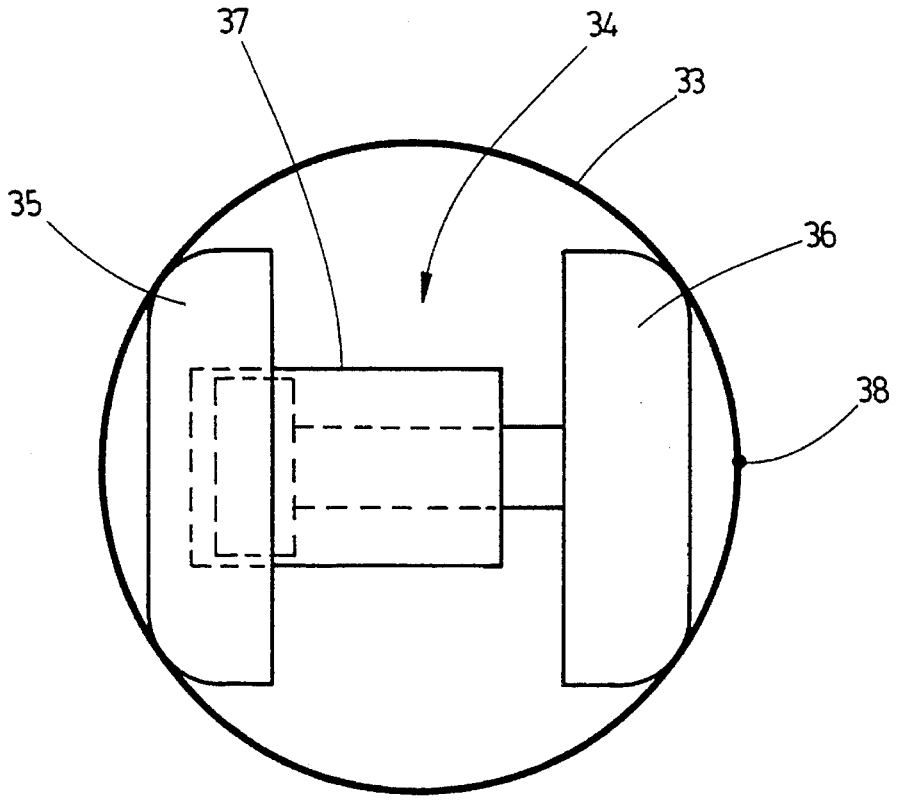
Figure 7:
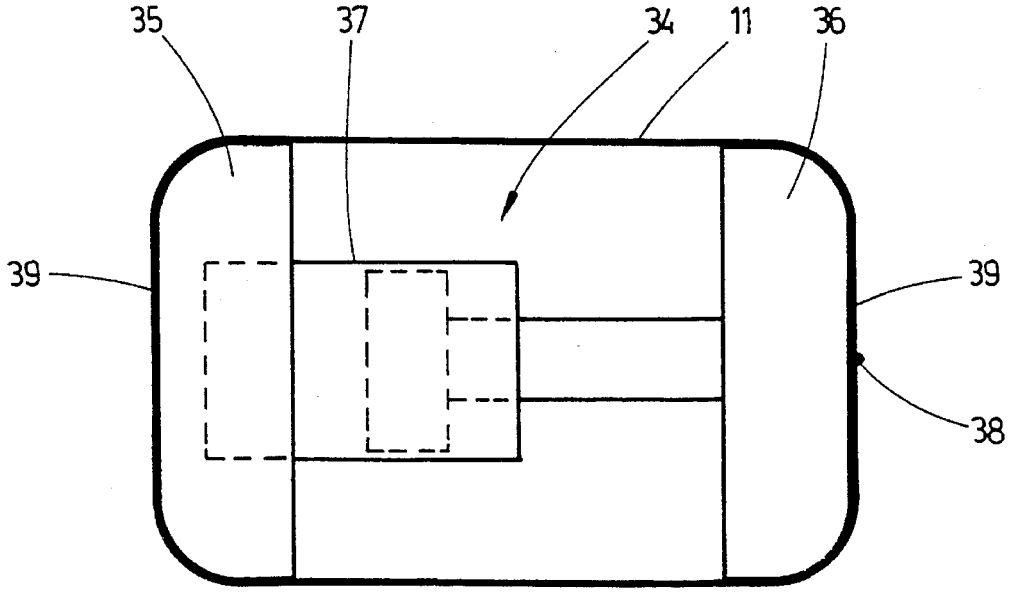

Pipe element 33 is fitted on a stretching press 34, whose expanding jaws 35, 36 are shaped like inner container 2 in the area of its narrow sides (FIG. 6). After pipe element 33 is applied, expanding jaws 35, 36 of stretching press 34 are moved apart by a pressure-medium cylinder 37 (FIG. 7). In this way, pipe element 33 assumes the shape of sheet-metal jacket 11. Pipe element 33 is so applied onto stretching press 34, that longitudinal weld 38 of pipe element 33 comes to rest on one of the narrow sides 39 of sheet metal jacket 11.

Figure 8:
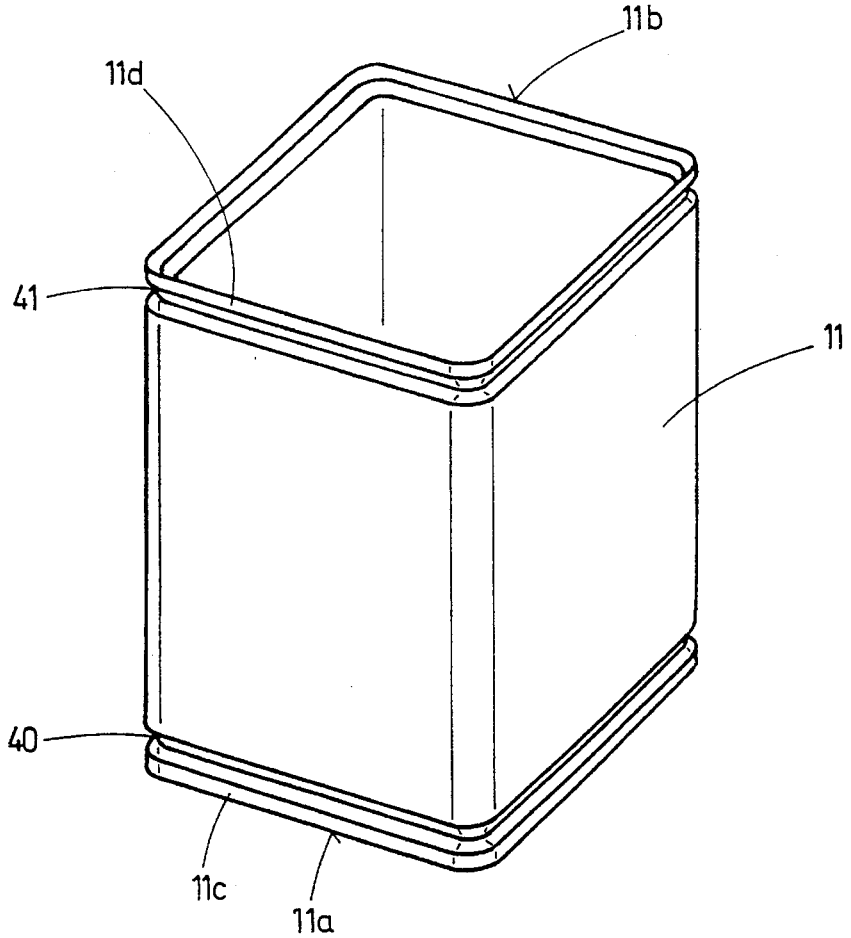
FIG. 8 is a perspective view of the sheet metal jacket of the inner container provided with beads for welding the bottom part and the cover.

In each of the two end areas of jacket 11, a peripheral bead 40, 41 is formed with a V-shaped section, e.g., rolled or pressed, at a distance from jacket edges 11*a*, 11*b* (FIG. 8).

Two outer edge strips 11*c*, 11*d* of jacket 11 which adjoin beads 40, 41, are cut to size.

Then, deep-drawn, tray-shaped bottom part 12 with a rounded edge 42 is superposed or joined exactly on or to outer side 40*a* of one bead 40 of jacket 11, and bottom part 12 is attached to jacket 11.

In the same way, deep-drawn or pressed cover 13 with a rounded edge 43 is then superposed or joined exactly on or to outer side 41*a* of the other bead 41 of jacket 11, and cover 13 is attached to jacket 11.

Figure 10:
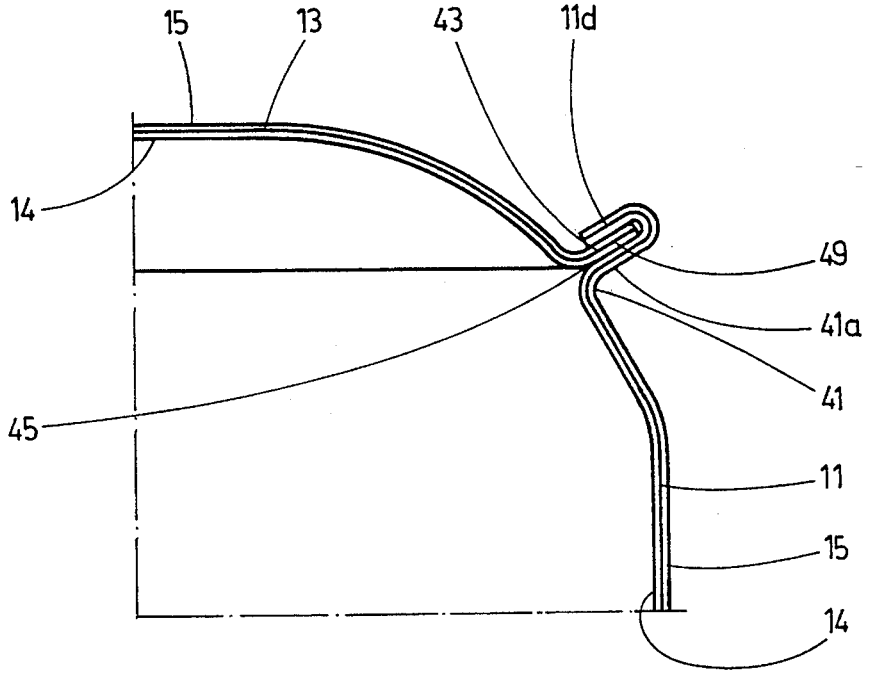

Bottom part 12 and cover 13 are welded fluid-tight, preferably roll-seam welded, to jacket 11 (FIGS. 9 and 10).

Edge strips 11*c*, 11*d* of container jacket 11 which project over rounded edges 42, 43 of bottom part 12 and of cover 13 are laid flat around rounded bottom edge 42 and cover edge 43.

In the last stage of the manufacturing process, annular gaps 45, which form between jacket 11 and bottom part 12 or cover 13 of inner container 2 and where liquid that can breed disease-causing germs when the pallet container is used in the food industry can collect during draining, are eliminated.

Figure 12:
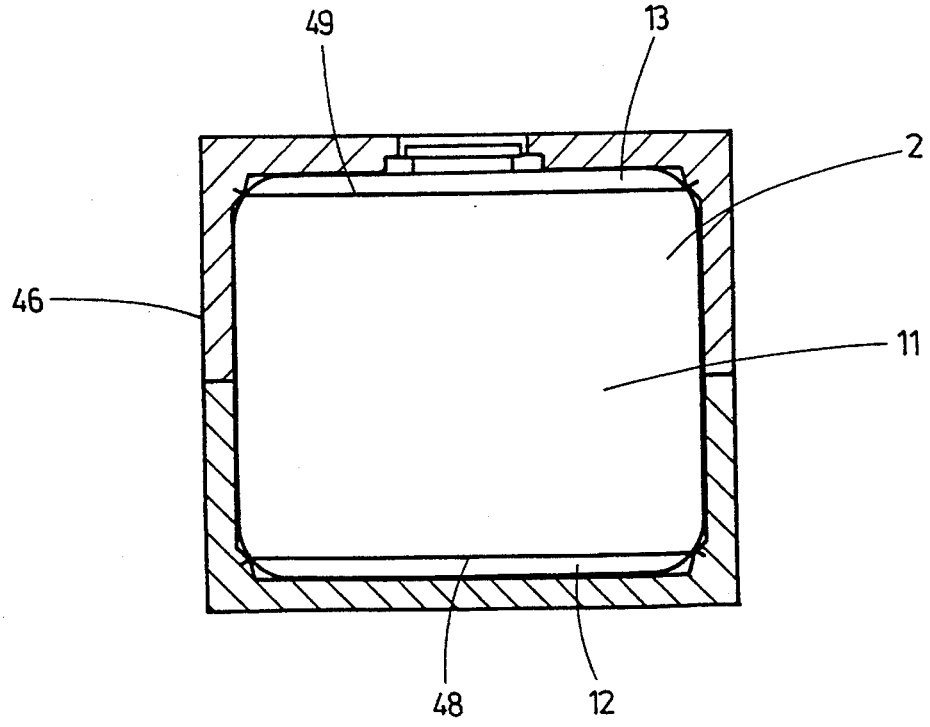
FIG. 12 shows the smoothing of the transitions between jacket and bottom as well as between the jacket and cover of the inner container by flaring in a supporting mold.
Figure 13:
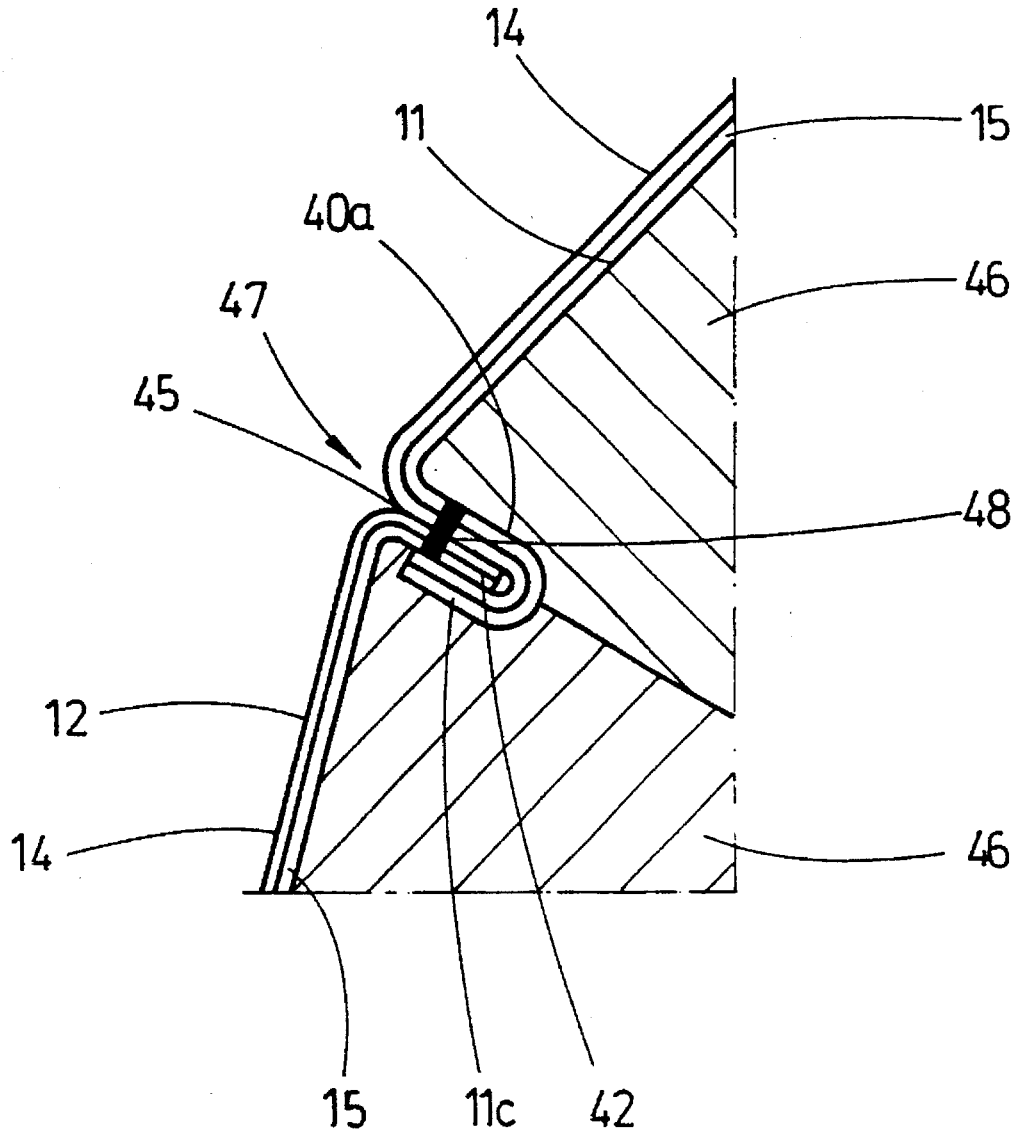
FIG. 13 shows a detail of the supporting mold in the area of the bottom weld of the inner container after the flaring process.

To eliminate annular gaps 45, inner container 2 is placed in a supporting mold 46, which is designed so that when container 2 is subjected to hydraulic or pneumatic pressure, inner transition areas 47 can flare to a limited extent between jacket 11 and bottom part 12, as well as jacket 11 and cover 13, and outer sides 40*a*, 41*a* of both beads 40, 41 which project outward in container jacket 11 and rounded edges 42, 43 of bottom 12 and of cover 13 that adjoin the latter can be gripped from the outside to keep the bottom weld 48 and cover weld 49 from tearing apart (FIGS. 12 and 13).

Elevated pressure in inner container 2 can be used to check the container for leaks.

What is claimed is:

1. A process for the production of an inner container made of sheet metal for a pallet container, comprising the following steps:

a) bending a rectangular sheet metal blank to form a pipe element;

b) welding mating edges of said pipe element lengthwise;

c) stretching said pipe element to form a jacket of rectangular cross-section having jacket edges;

d) forming a peripheral bead with a v-shaped cross section in each of two end areas of said jacket at a distance from said jacket edges;

e) cutting to size two outer edge strips of said jacket which adjoin said beads;

f) superposing a bottom part with a rounded edge on an outer side of a bead of said jacket and attaching said bottom part to said jacket;

g) superposing a cover with a rounded edge on an outer side of the other said bead of said jacket and attaching said cover to said jacket;

h) fluidtightly welding said bottom part and said cover to said jacket to form said inner container;

i) laying flat said edge strips of said jacket over corresponding rounded edges of said bottom part and of said cover;

j) flaring inner transition areas between said jacket and said bottom part and between said jacket and said cover of said inner container in a supporting mold to eliminate annular gaps that form between said jacket and bottom part, as well as between said jacket and cover, by pressurization of said inner container; and k) checking said inner container for leaks under internal pressure.

* * * * *